US010729930B2

(12) United States Patent
Thompson

(10) Patent No.: US 10,729,930 B2
(45) Date of Patent: Aug. 4, 2020

(54) WEIGHT LIFTING APPARATUS

(71) Applicant: Tyler Thompson, Tucson, AZ (US)

(72) Inventor: Tyler Thompson, Tucson, AZ (US)

( * ) Notice: Subject to any disclaimer, the term of this patent is extended or adjusted under 35 U.S.C. 154(b) by 236 days.

(21) Appl. No.: 15/596,294

(22) Filed: May 16, 2017

(65) Prior Publication Data

US 2018/0333604 A1 Nov. 22, 2018

(51) Int. Cl.

| | |
|---|---|
| ***A63B 21/00*** | (2006.01) |
| ***A63B 21/065*** | (2006.01) |
| ***A63B 1/00*** | (2006.01) |
| ***A47F 9/00*** | (2006.01) |
| ***A63B 21/072*** | (2006.01) |
| *A41F 9/00* | (2006.01) |

(52) U.S. Cl.

CPC ..... *A63B 21/4009* (2015.10); *A63B 1/00* (2013.01); *A63B 21/065* (2013.01); *A41F 9/002* (2013.01); *A63B 21/0724* (2013.01); *A63B 2244/09* (2013.01)

(58) Field of Classification Search

CPC ..... A63B 21/40; A63B 21/06; A63B 21/05; A63B 21/07; A63B 2244/00; A61F 9/00

See application file for complete search history.

(56) References Cited

U.S. PATENT DOCUMENTS 1,840,945 A * 1/1932 Guinzburg ..... A61F 13/64 2/338
1,951,450 A * 3/1934 Sochel ..... A41F 9/025 2/237
3,295,517 A * 1/1967 Stevens ..... A61F 5/0104 602/19
5,201,074 A * 4/1993 Dicker ..... A41D 13/0015 2/227
5,465,428 A * 11/1995 Earl ..... A63B 21/0552 2/227
5,778,452 A * 7/1998 Dicker ..... A41D 13/0015 2/227
5,857,947 A * 1/1999 Dicker ..... A63B 21/00185 2/69.5
5,978,966 A * 11/1999 Dicker ..... A41D 13/0015 2/115
6,176,816 B1 * 1/2001 Dicker ..... A63B 21/00185 2/69.5
6,213,922 B1 * 4/2001 Afanasenko, IV ..... A61F 5/01 482/124
6,684,410 B2 * 2/2004 Robinett ..... A41D 1/08 2/228
7,730,552 B2 * 6/2010 Ota ..... A41D 13/0015 2/227
7,744,511 B2 * 6/2010 Grigoriev, IV ..... A61F 5/0102 482/121

(Continued)

*Primary Examiner* — Garrett K Atkinson

(74) *Attorney, Agent, or Firm* — University of Arizona IP Clinic

(57) ABSTRACT

A weight lifting apparatus to assist an exerciser to lift more weight for more repetitions in the squat and deadlift, the apparatus including an upper sleeve, made of strong, inelastic material, in which a weight lifting belt can be inserted therethrough, and two interweaved elastic cross members each having one end attached to the sleeve, where the remaining portions cross behind the exerciser's gluteus, where a second end of each elastic cross member includes a leg cuff.

8 Claims, 6 Drawing Sheets

(56) References Cited

U.S. PATENT DOCUMENTS

| | | | | |
|---|---|---|---|---|
| 7,931,571 | B2 * | 4/2011 | Bernardoni | A61F 5/0102 434/255 |
| 8,986,177 | B2 * | 3/2015 | von Hoffmann | A63B 23/0494 482/124 |
| 9,375,603 | B2 * | 6/2016 | Matsuura | A63B 21/02 |
| 9,498,691 | B2 * | 11/2016 | Antoine | A63B 69/0022 |
| 10,124,205 | B2 * | 11/2018 | Matsuura | A63B 21/0414 |
| 2004/0116260 | A1 * | 6/2004 | Drennan | A61F 5/0193 482/124 |
| 2015/0190669 | A1 * | 7/2015 | Matsuura | A63B 21/02 482/8 |
| 2015/0196789 | A1 * | 7/2015 | Whitt | A63B 21/00185 482/124 |
| 2016/0038783 | A1 * | 2/2016 | Matsuura | A63B 21/02 482/124 |

* cited by examiner

WEIGHT LIFTING APPARATUS

FIELD OF THE INVENTION

Applicant's disclosure is directed to a weight lifting apparatus to be worn by a user.

BACKGROUND OF THE INVENTION

Recently, there is an increasing demand for weightlifting apparatuses that assist with lifting weights. Specifically, there is a demand for an apparatus to assist with squats and deadlifts; yet, there are currently no lifting apparatuses to assist with the squat and/or deadlift. Prior art for apparatuses that have leg cuffs attached to a waist belt are not designed to be used for weightlifting and they are not designed to withstand nor assist with heavy weight.

SUMMARY OF THE INVENTION

A weight lifting apparatus is disclosed. Applicant's weight lifting apparatus comprises a tubular member, having a first open end and a second open end, and configured to allow a belt to be inserted into and through said first open end such said belt extends outwardly from the second open end, in combination with two elastic members, each comprising a first end and a second end, wherein a first end of each elastic member is attached to the sleeve, and wherein the second end of each elastic member is formed to define a leg cuff.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF THE PREFERRED EMBODIMENTS

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention, and it will be appreciated by those skilled in the art that it is intended to cover alternatives, modifications, and equivalents as may be included within the spirit and scope of the invention as defined by the appended claims and their equivalents as supported by the following disclosure and drawings.

Applicant's lifting apparatus is designed to be worn on the outside of one's clothes, and is designed to be easily put on and taken off, without the need of removing articles of clothing. The apparatus comprises a sleeve through which a weight lifting belt is disposed around the users waist/lower back, and two cross sections of sufficient length traveling in a downwardly diagonal direction as to encircle the user's lower thigh, knee, and upper calf.

As those skilled in the art will appreciate, "elastic members," "elastomers." and "flexible member" may be used interchangeably herein. ASTM D1566 defines an elastomer as "a macromolecular material which, at room temperature, is capable of recovering substantially in shape and size after removal of a deforming force."

Figure 6A:
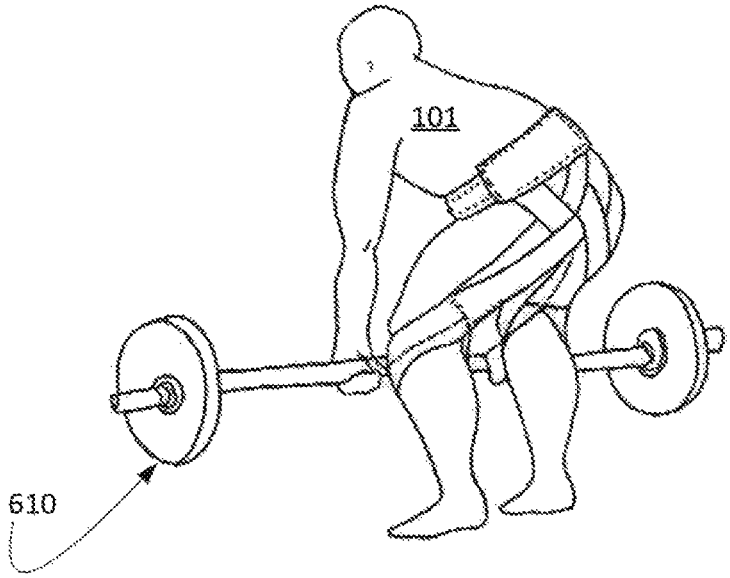
FIG. 6A shows a user in a squat position wearing Applicant's weight lifting apparatus, and about to lift a horizontal bar in combination with two or more barbells.
Figure 6B:
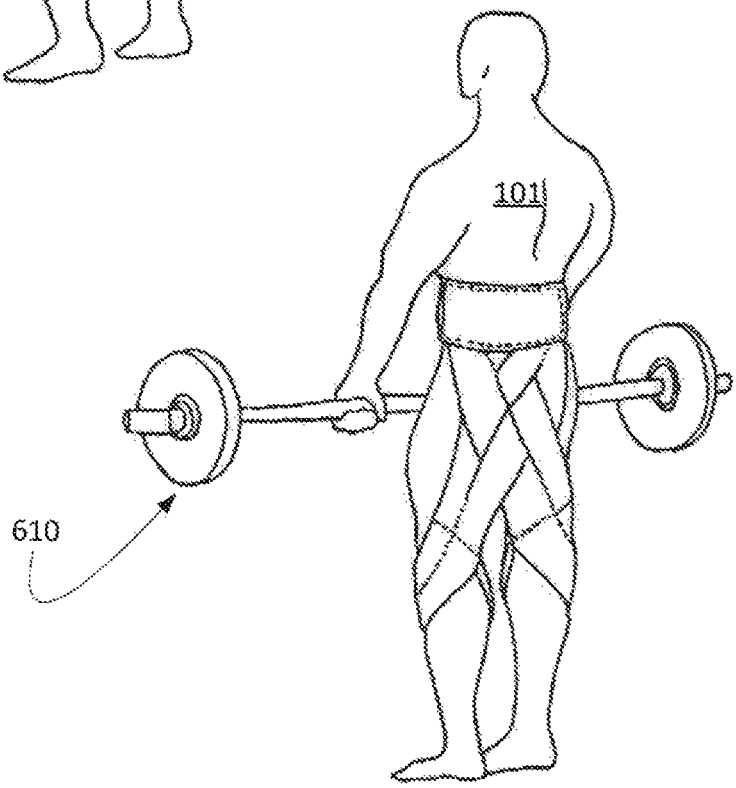
FIG. 6B shows the user of FIG. 6A in an upright position.

Referring now to FIGS. 6A and 6B. FIG. 6A shows a weight lifter 101 in a squat position and wearing Applicant's weight lifting apparatus. FIG. 6B illustrates weight lift 101 in an upright position holding weight 610.

Figure 1:
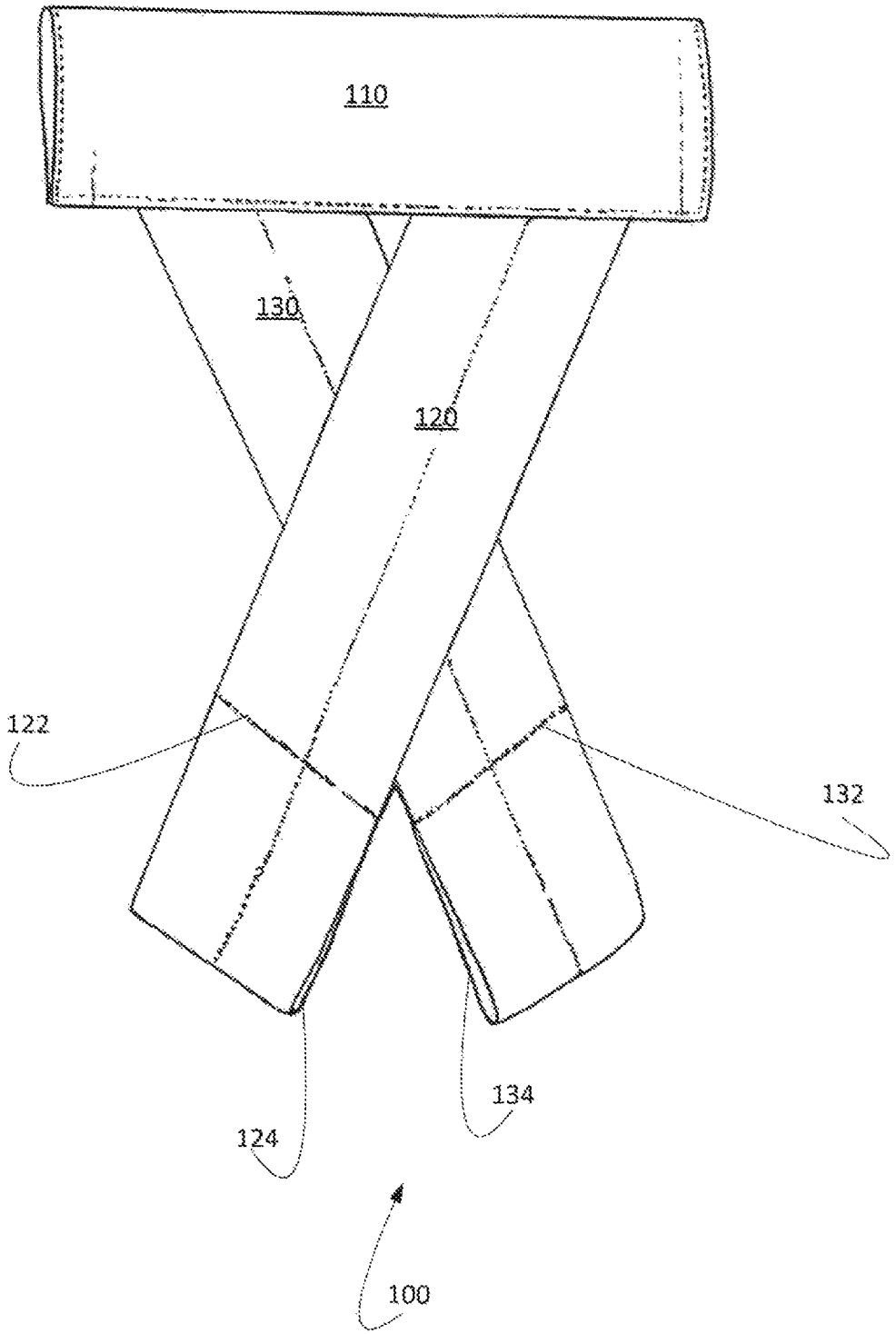
FIG. 1 illustrates a first embodiment of Applicant's weight lifting apparatus.

FIG. 1 illustrates a first embodiment of Applicant's weight lifting apparatus 100. Referring to FIG. 1, assembly 100 comprises a first embodiment of Applicant's weight lifting apparatus. In certain embodiments, sleeve 110 comprises, for example and without limitation, a strong, inflexible material such as canvas or denim. Sleeve may also be formed of one or more layers sewn together to not only strengthen the sleeve, but also increase its durability.

Flexible member 120 is attached to sleeve 110, and extends outwardly therefrom at an angle of about 45 degrees. End 122 of flexible member 120 is affixed to a flexible member 120 to form a leg cuff 124.

Flexible member 130 is attached to sleeve 110, and extends outwardly therefrom at an angle of about 45 degrees. Flexible member 120 crosses over flexible member 130. End 132 of flexible member 130 is affixed to a flexible member 130 to form a leg cuff 134.

Figure 2:
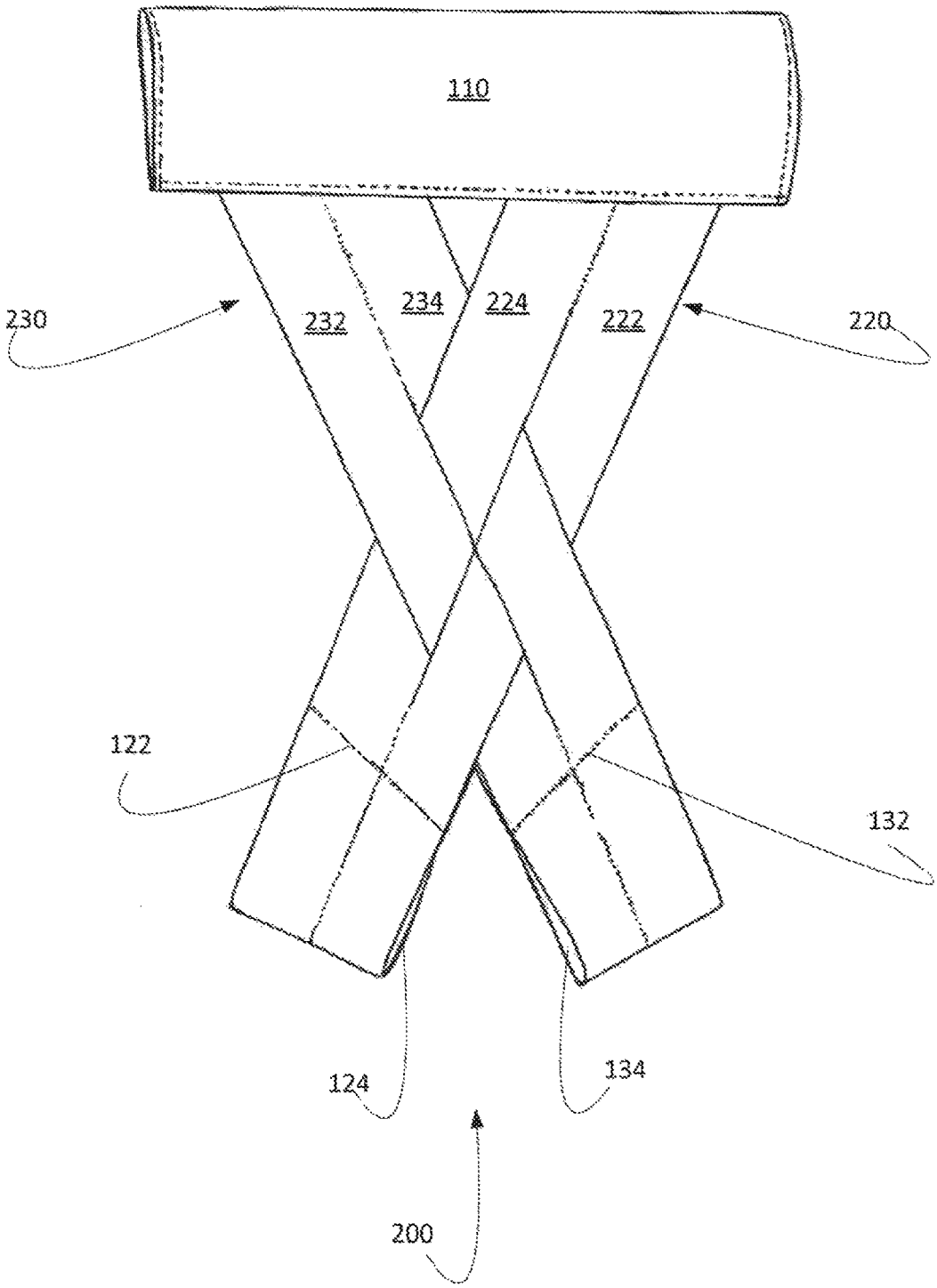
FIG. 2 illustrates a second embodiment of Applicant's weight lifting apparatus.

Referring now to FIG. 2, assembly 200 comprises a second embodiment of Applicant's weight lifting apparatus. Flexible member 220 is attached to sleeve 110, and extends outwardly therefrom at an angle of about 45 degrees. End 122 of flexible member 220 is affixed to a flexible member 220 to form a leg cuff 124.

Flexible member 230 is attached to sleeve 110, and extends outwardly therefrom at an angle of about 45 degrees. Flexible member 220 crosses over flexible member 230. End 132 of flexible member 230 is affixed to a flexible member 230 to form a leg cuff 134.

In the illustrated embodiment of FIG. 2, flexible member 220 comprises flexible member 222 and flexible member 224 selectively attached to one another longitudinally. Flexible member 232 is interleaved with flexible member 222. Similarly, flexible member 234 is interleaved with flexible member 224.

In certain embodiments, Applicant's weight lifting apparatus comprises both a flexible member 120 and a flexible member 220, where flexible member 120 overlies flexible member 220. In certain embodiments, flexible member 120 is physically attached to flexible member 220.

In certain embodiments, Applicant's weight lifting apparatus comprises both a flexible member 130 and a flexible member 230, where flexible member 130 overlies flexible member 230. In certain embodiments, flexible member 130 is physically attached to flexible member 230.

Figure 3:
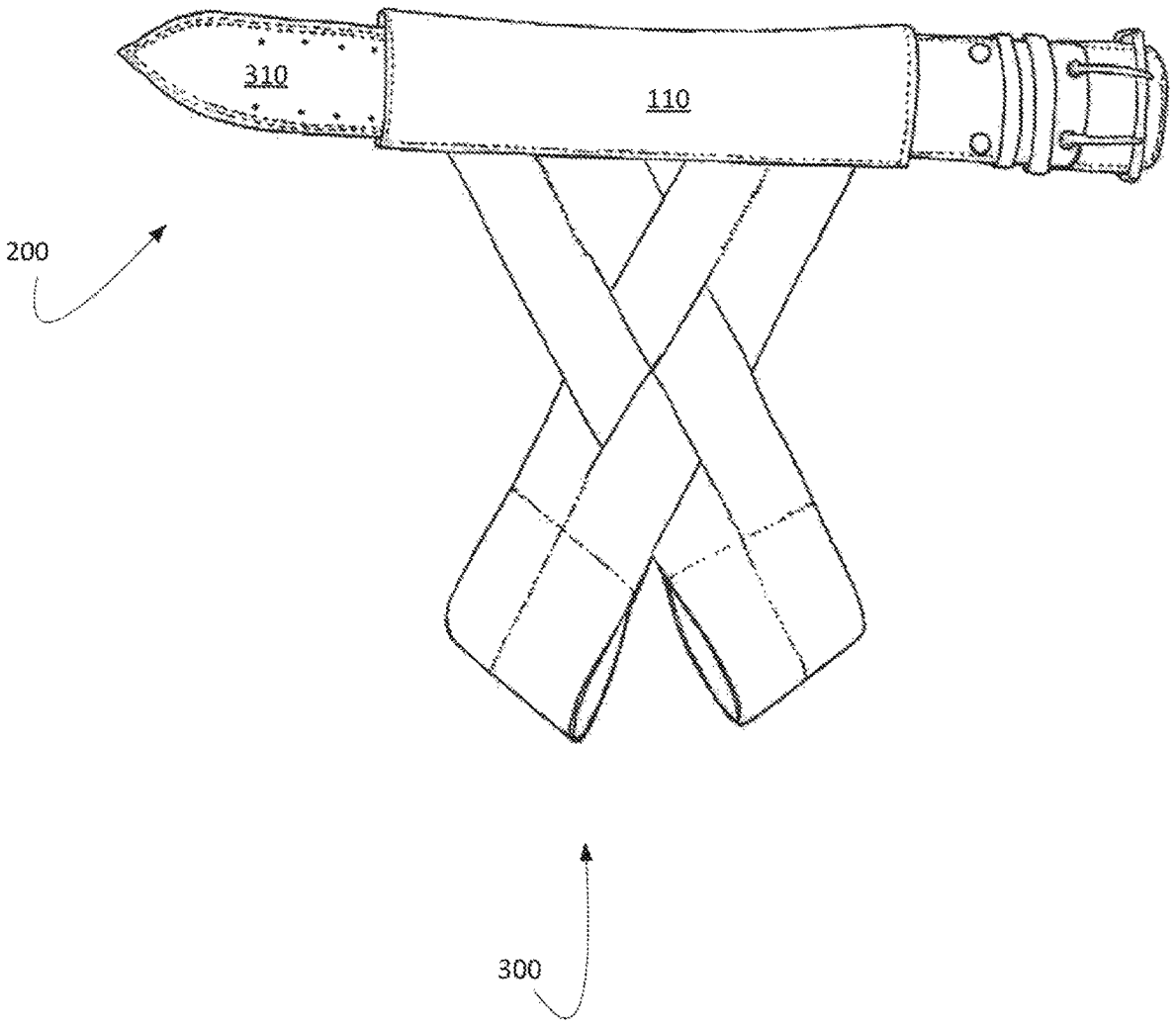
FIG. 3 illustrates a weight lifting belt disposed in the sleeve 110 of FIG. 1.

Referring now to FIG. 3, sleeve 110 will have an inner diameter wide enough to allow a weight lifting belt 310 to slide therethrough, allowing Applicant's weight lifting apparatus to be cinched around the user's waist. In some embodiments, the apparatus may also be comprised of more than one layer of material, in order to provide more assistance with the lift being performed. These additional layers may follow the same path as the first layer, continue as one unbroken section and cross back into the upper sleeve, or additional layers may just be stitched between the leg cuffs and the upper sleeve, and may be comprised of one or more of the elastic materials above. It is also to be understood that the leg cuffs may be positioned cither slightly higher or lower on the exerciser's legs, based on user comfort.

Figure 4:
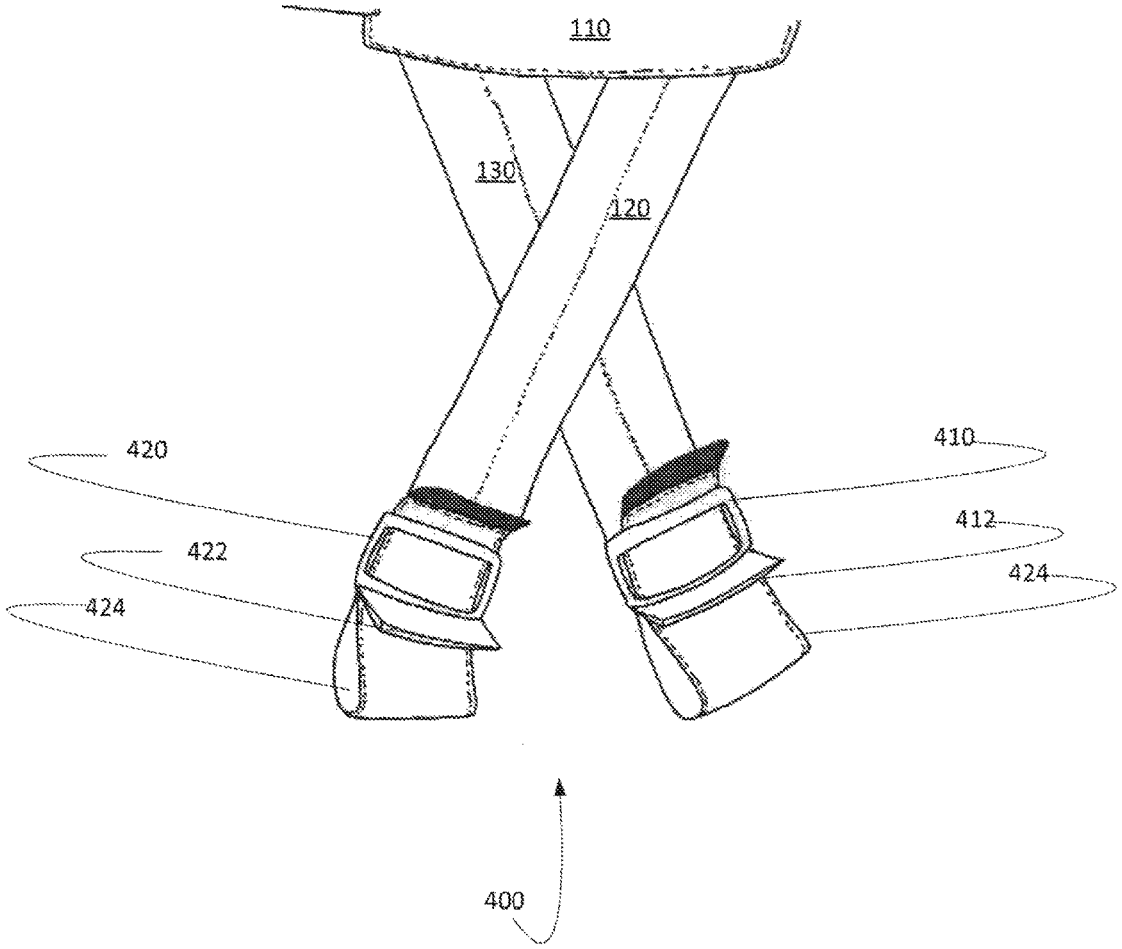
FIG. 4 illustrates a third embodiment of Applicant's weight lifting apparatus.

FIG. 4 illustrates a third embodiment 400 of Applicant's weightlifting apparatus. Referring now to FIG. 4, a distal end 422 of flexible member 120 has been passed through buckle 420 to define leg cuff 424. Similarly, a distal end 412 of flexible member 130 has been passed through buckle 410 to define leg cuff 414.

Figure 5:
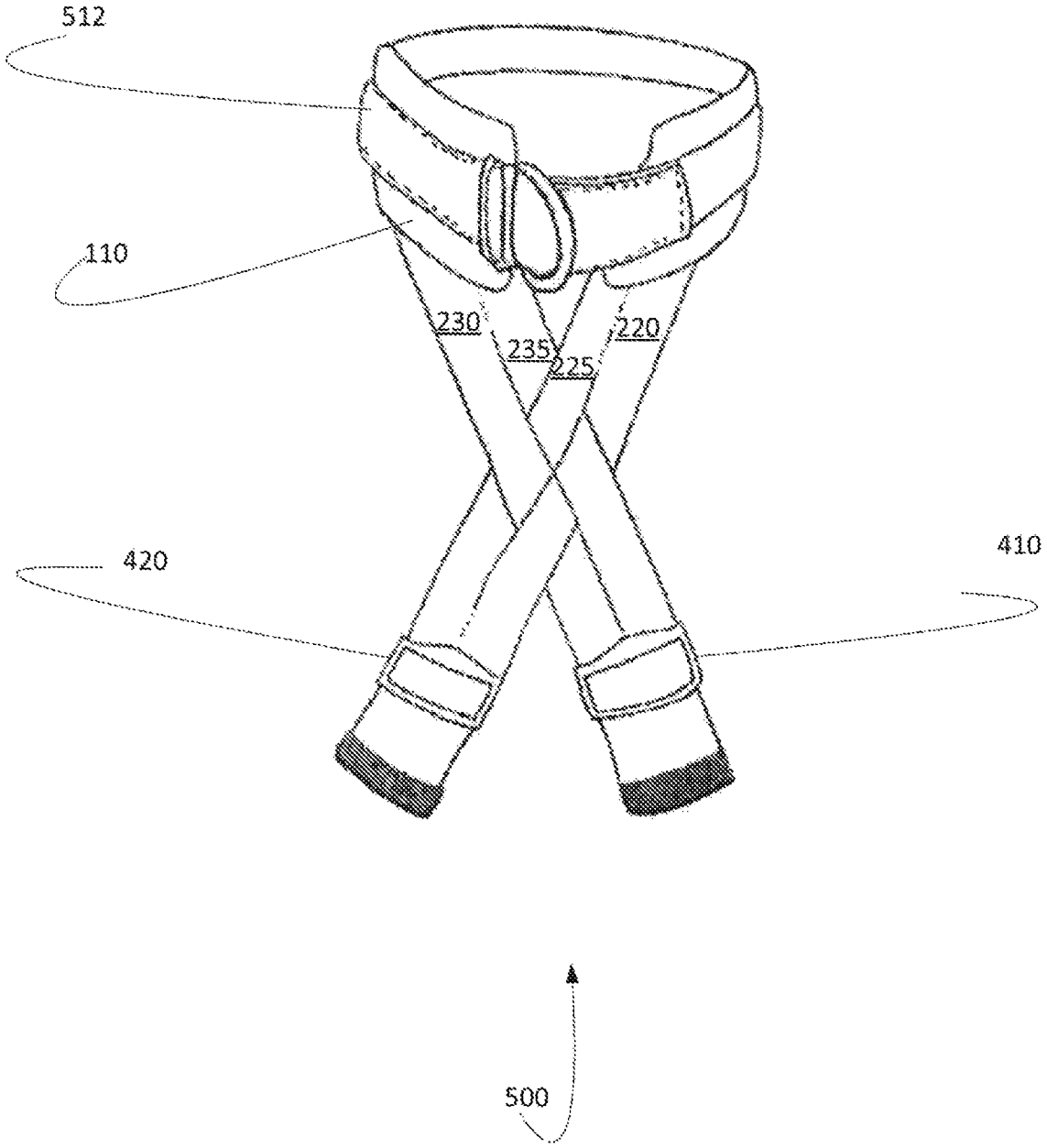
FIG. 5 illustrates a fourth embodiment of Applicant's weight lifting apparatus.

FIG. 5 illustrates a fourth embodiment 500 of Applicant's weight lifting apparatus. Referring now to FIG. 5, apparatus 500 comprises sleeve 110 in combination with an integral belt 512. The illustrated embodiment of FIG. 5 further includes buckles 410 and 420, utilized as described hereinabove in conjunction with apparatus 400 (FIG. 4).

While the preferred embodiments of the present invention have been illustrated in detail, it should be apparent that modifications and adaptations to those embodiments may occur to one skilled in the art without departing from the scope of Applicant's disclosure.

I claim:

1. A weight lifting apparatus, comprising:

a tubular member, comprising a first open end and a second open end, and configured to allow a belt to be inserted into and through the tubular member;

a first elastic member attached to said tubular member at a first end, configured to be worn on a left hip, and a second end formed to define a first leg cuff configured to be worn on the right leg;

a second elastic member attached to said tubular member at a third end, configured to be worn on a right hip, and a fourth end formed to define a second leg cuff configured to be worn on the left leg, wherein:

the first elastic member comprises a first portion and a second portion, which are attached to each other and the first leg cuff; and the second elastic member comprises a third portion and a fourth portion which are attached to each other and the second leg cuff; wherein:

the attachments maintain an interleaved structure between the first, second, third and fourth portions.

2. The weight lifting apparatus of claim 1, wherein:

the first elastic member extends outwardly from said tubular member at an angle of about +45 degrees; and the second elastic member extends outwardly from said tubular member at an angle of about −45 degrees.

3. The weight lifting apparatus of claim 1, further comprising a sleeve in combination with an integral belt.

4. The weight lifting apparatus of claim 1, wherein said two elastic members are formed from one or more elastomers.

5. The weight lifting apparatus of claim 1, wherein said two elastic members have a length from about 30 to about 50 inches.

6. The weight lifting apparatus of claim 1, wherein said two elastic members have a width of about 6 inches.

7. The weight lifting apparatus of claim 1, wherein each of the first and the second elastic members have a maximum elongation of about 50 percent.

8. The weight lifting apparatus of claim 1, wherein said first leg cuff is configured to be worn below a right knee and above a right calf; and wherein said second leg cuff is configured to be worn below a left knee and above a left calf.

* * * * *